US009524860B1

(12) United States Patent
Remes

(10) Patent No.: US 9,524,860 B1
(45) Date of Patent: Dec. 20, 2016

(54) SYSTEMS AND METHODS FOR MULTIPOLE OPERATION

(71) Applicant: Thermo Finnigan LLC, San Jose, CA (US)

(72) Inventor: Philip M. Remes, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/866,013

(22) Filed: Sep. 25, 2015

(51) Int. Cl.
*H01J 49/42* (2006.01)

(52) U.S. Cl.
CPC ..... *H01J 49/4285* (2013.01); *H01J 49/4245* (2013.01); *H01J 49/4255* (2013.01)

(58) Field of Classification Search
CPC . H01J 49/4245; H01J 49/4255; H01J 49/4285
See application file for complete search history.

(56) References Cited

U.S. PATENT DOCUMENTS 6,872,938 B2 * 3/2005 Makarov ..... B82Y 30/00 250/281
7,227,130 B2 * 6/2007 Hager ..... H01J 49/0095 250/282
2009/0140141 A1 * 6/2009 Hansen ..... H01J 49/4225 250/292
2009/0159796 A1 * 6/2009 Belford ..... H01J 49/063 250/294
2009/0294663 A1 * 12/2009 Muntean ..... H01J 49/063 250/292
2010/0038530 A1 * 2/2010 Giles ..... H01J 49/4235 250/283
2010/0301227 A1 * 12/2010 Muntean ..... H01J 49/421 250/396 R
2011/0278450 A1 * 11/2011 Loucks, Jr. ..... H01J 49/005 250/290
2011/0284741 A1 * 11/2011 Stoermer ..... H01J 49/063 250/292
2012/0305762 A1 * 12/2012 Kaneko ..... H01J 49/427 250/283

(Continued)

FOREIGN PATENT DOCUMENTS

EP 2924712 A1 9/2015
WO 2008/081334 A2 7/2008

(Continued)

OTHER PUBLICATIONS

Franzen, "Simulation Study of an Ion Cage with Superimposed Multipole Fields". International Journal of Mass Spectrometry and Ion Processes, 1991, vol. 106, pp. 63-78.

*Primary Examiner* — Wyatt Stoffa
(74) *Attorney, Agent, or Firm* — David A. Schell

(57) ABSTRACT

A method for identifying components of a sample includes providing a sample to an ion source and generating a plurality of ions from constituent components of the sample, applying a first RF waveform at a first RF amplitude to an ion trap with field resonances while directing the plurality of ions into the ion trap, and applying a second RF waveform at a second RF amplitude to the ion trap while focusing the plurality of ions towards the center of the ion trap along the longitudinal axis. The method further includes ejecting the plurality of ions from the ion trap into a mass analyzer, and using the mass analyzer to determine the mass-to-charge ratio of the ions.

19 Claims, 6 Drawing Sheets

(56) References Cited

U.S. PATENT DOCUMENTS

| | | | | |
|---|---|---|---|---|
| 2013/0284918 | A1* | 10/2013 | Okumura | H01J 49/063 250/288 |
| 2015/0279640 | A1* | 10/2015 | Flory | H01J 49/4285 250/283 |
| 2016/0013039 | A1* | 1/2016 | Brown | H01J 49/403 250/282 |

FOREIGN PATENT DOCUMENTS

| | | | |
|---|---|---|---|
| WO | 2010/132366 | A1 | 11/2010 |
| WO | 2013/038211 | A1 | 3/2013 |

* cited by examiner

SYSTEMS AND METHODS FOR MULTIPOLE OPERATION

FIELD

The present disclosure generally relates to the field of mass spectrometry including systems and methods for multipole operation.

INTRODUCTION

Mass spectrometry relies upon the measurement of physical values that can be related to the mass-to-charge ratio (m/z) to determine a mass of an ionic species or a compound within a sample. The ORBITRAP mass analyzer is a very powerful analytical instrument, able to achieve high resolving power, mass accuracy and dynamic range, without the use of the superconducting magnets utilized in the previous generation of Fourier Transform based instruments, the ion cyclotron resonance machines. One of the key aspects of mass analysis via an electrostatic trap analyzer, such as an ORBITRAP mass analyzer, is the method for introducing ions to the trap. Generally, ions are introduced in bunches from an external accumulation device. A curved linear multipole has been previously described (U.S. Pat. No. 6,872,938 filed Mar. 20, 2002 and incorporated herein by reference) that introduces ions to the electrostatic trap in a manner well-suited for mass analysis. The ions should be focused to a very small size, so that the dimensions of the entrance aperture to the ORBITRAP mass analyzer can be kept small, causing the minimum disturbance to the ORBITRAP mass analyzer internal fields. The ions should also all enter the trap within a very narrow time window. The curvature of the rods helps provide proper focusing of the ions to the entrance slit of the ORBITRAP mass analyzer. The curved nature of the multipole, however, can cause field non-linearities and associated resonances. Perturbations to the electrode structure having certain symmetric properties introduce non-linear fields to the nominally linear fields of a quadrupole device, which cause characteristic overtone oscillations in the ion motion. Under certain conditions, the overtones and fundamental ion oscillation frequencies can coincide, with the result that ions gain energy from the trapping field and may be ejected from the device. This phenomenon limits the usable mass range of the device.

From the foregoing it will be appreciated that a need exists for improved operation of multipoles for mass spectrometry.

SUMMARY

In a first aspect, a method for identifying components of a sample can include providing a sample to an ion source and generating a plurality of ions from constituent components of the sample, applying a first RF waveform at a first RF amplitude to an ion trap with field resonances while directing the plurality of ions into the ion trap, and applying a second RF waveform at a second RF amplitude to the ion trap while focusing the plurality of ions towards the center of the ion trap along the longitudinal axis. The method can further include ejecting the plurality of ions from the ion trap into a mass analyzer, and using the mass analyzer to determine the mass-to-charge ratio of the ions. The first and second RF amplitudes can be selected to increase the mass range of ions that are ejected into the mass analyzer.

In various embodiments of the first aspect, the second amplitude can be selected to avoid resonances caused by field non-linearities within the ion trap.

In various embodiments of the first aspect, the first amplitude can be greater than the second amplitude.

In various embodiments of the first aspect, the method can further include applying a third RF waveform at a third amplitude after the ions have entered the curve ion trap and before the ions are focused towards the center of the ion trap.

In various embodiments of the first aspect, the third amplitude can be greater than the second amplitude.

In various embodiments of the first aspect, at least a portion of the ions within the ion trap can have a secular frequency above the field resonance at the first amplitude.

In various embodiments of the first aspect, the ions within the ion trap can have a secular frequency less than the field resonance at the second amplitude.

In a second aspect, a system for analyzing a sample can include a source configured to generate ions from constituent components of the sample, a mass analyzer configured to determine the mass-to-charge ratio of the ions, and an ion trap configured to focus ions and transfer the ions to the mass analyzer, and an RF controller. The ion trap can have field resonances. The RF controller can be configured to apply a first RF waveform at a first RF amplitude to the ion trap while directing the plurality of ions into the ion trap, and apply a second RF waveform at a second RF amplitude to the ion trap while focusing the plurality of ions towards the center of the curvature.

In various embodiments of the second aspect, the second amplitude can be selected to avoid resonances caused by field non-linearities within the ion trap.

In various embodiments of the second aspect, the first amplitude can be greater than the second amplitude.

In various embodiments of the second aspect, the RF controller can be further configured to apply a third RF waveform at a third amplitude after the ions have entered the curve ion trap and before the ions are focused towards the center of the ion trap.

In various embodiments of the second aspect, the third amplitude can be greater than the second amplitude.

In various embodiments of the second aspect, at least a portion of the ions within the ion trap can have a secular frequency above the field resonance at the first amplitude.

In various embodiments of the second aspect, the ions within the ion trap can have a secular frequency less than the field resonance at the second amplitude.

In a third aspect, a method for identifying components of a sample can include providing a sample to an ion source and generating a plurality of ions from constituent components of the sample, applying a first RF waveform at a first RF amplitude to an ion trap with field resonances while directing the plurality of ions into the ion trap, and applying a second RF waveform at a second RF amplitude to the ion trap while focusing the plurality of ions towards the center of the curvature. The method can further include ejecting the plurality of ions from the ion trap into a mass analyzer, and using the mass analyzer to determine the mass-to-charge ratio of the ions. The second RF amplitude can be below a threshold selected to avoid resonances caused by field non-linearities within the ion trap and the first RF amplitude can be above the threshold.

In various embodiments of the third aspect, the first and second RF amplitudes can be selected to increase the mass range of ions that are ejected into the mass analyzer.

In various embodiments of the third aspect, the method can further include applying a third RF waveform at a third amplitude after the ions have entered the ion trap and before the ions are focused towards the center of the ion trap.

In various embodiments of the third aspect, the third amplitude can be greater than the second amplitude.

In various embodiments of the third aspect, at least a portion of the ions within the ion trap can have a secular frequency above the field resonance at the first amplitude.

In various embodiments of the third aspect, the ions within the ion trap can have a secular frequency less than the field resonance at the second amplitude.

DRAWINGS

For a more complete understanding of the principles disclosed herein, and the advantages thereof, reference is now made to the following descriptions taken in conjunction with the accompanying drawings, in which.

Figure 1:
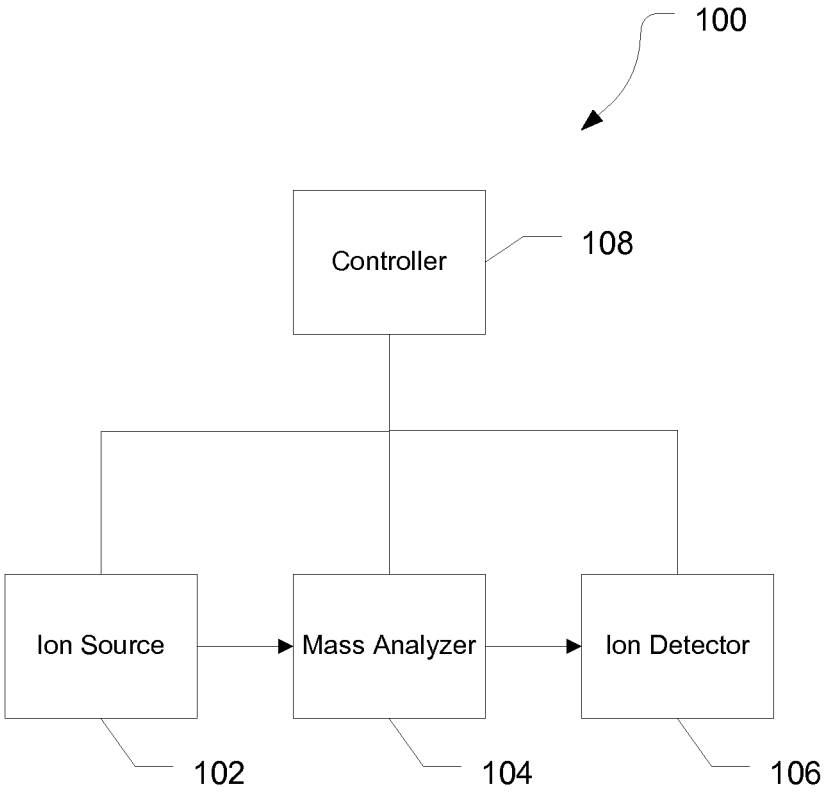
FIGS. 1 and 2 are a block diagram of an exemplary mass spectrometry systems, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for multipole operation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap mass analyzer (e.g., ORBITRAP mass analyzer), Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configured the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Figure 2:
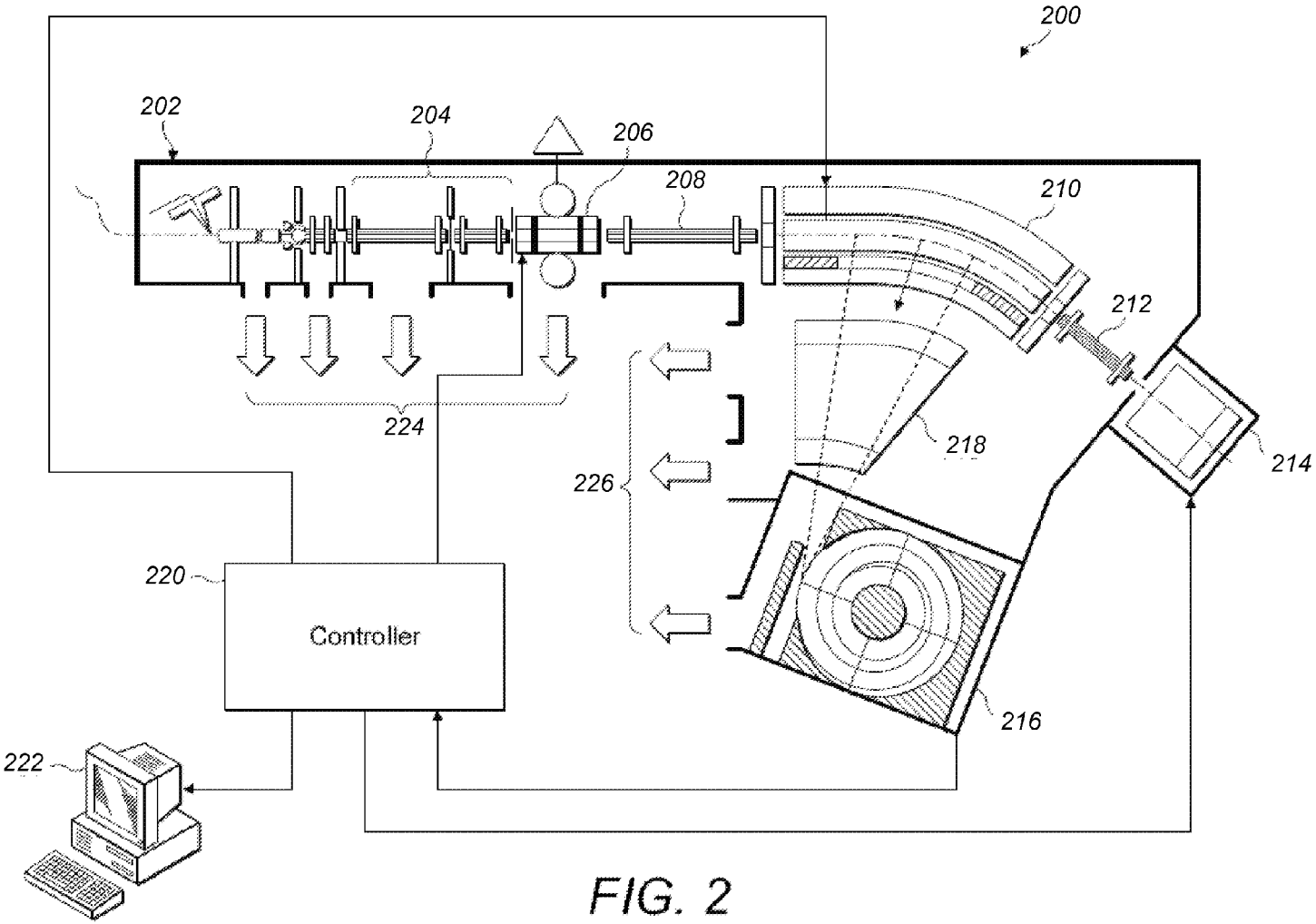

In FIG. 2, a tandem mass spectrometer 200 has an ion source 202 which is shown as an electrospray ion source but might be any other suitable form of quasi continuous or pulsed ion source.

Ions from the ion source 202 pass through ion optics 204 and into a linear trap 206. The linear trap may be a quadrupole ion trap or might have higher order (hexapole or octapole) rod electrodes instead.

The linear trap 206 stores ions from the ion source 202 within a selected subsidiary mass range. Stored ions are then ejected from the linear trap 206 by adjusting the DC voltage on end caps thereof, in known manner, so that the ions pass through second ion optics 208 into a curved or C-trap 210. The C-trap 210 has a longitudinal axis which is curved as will be familiar to those skilled in the art. Ions from the linear trap 206 are transferred along the curved longitudinal axis of the C-trap 210 pass through optional third ion optics 212 into fragmentation cell 214 which is thus positioned in a "dead end" location out of the path from the source through the linear trap 206 and C-trap 210 into an orbital trap, such as an ORBITRAP mass analyzer 216.

After ions are injected into the fragmentation cell 214 and fragmented or just stored, they are ejected back through the optional third ion optics 212 into the C-trap 210 again. They are then stored along the longitudinal curved axis of the C-trap 210 before ejection orthogonally through the ion lens 218 and into the ORBITRAP mass analyzer 216.

In alternate embodiments, the ions can be accumulated in the C-trap 210 and ejection orthogonally through the ion lens 218 and into the ORBITRAP mass analyzer 216 without first traveling to the fragmentation cell 214.

An image current obtained from ions is subjected to a Fourier transform so as to produce a mass spectrum as is known in the art.

The various components of the tandem mass spectrometer 200 of FIG. 2 are under the control of a controller 220 again. The controller 220 controls the linear trap 206 so as to adjust the voltages on the rods and the DC voltage on the end caps, in turn to select a particular mass range and then eject it to the C-trap 210. The controller 220 controls the C-trap 210 to eject the received ions there orthogonally to the ORBITRAP mass analyzer 216 and/or axially to the fragmentation cell 214. The controller 220 also controls the fragmentation cell 214 so that an appropriate fragmentation energy (or energies) can be applied to the ions. Finally, the controller 220 may be configured to receive the data from the image current detector of the ORBITRAP mass analyzer 216 for processing and/or onwards transmission to an external computer 222.

Each of the components within the tandem mass spectrometer 200 can reside in vacuum chambers which may be differentially pumped and the differential pumping is indicated at reference numerals 224 and 226 in FIG. 2.

Mass Analysis Method

One definition for the mass range of an RF device may be given as the ratio of the maximum voltage that can trap a particular m/z to the minimum voltage that can trap the same m/z.

$$MR = \frac{V_{max}}{V_{min}} \quad \text{(Equation 1)}$$

Figure 5:
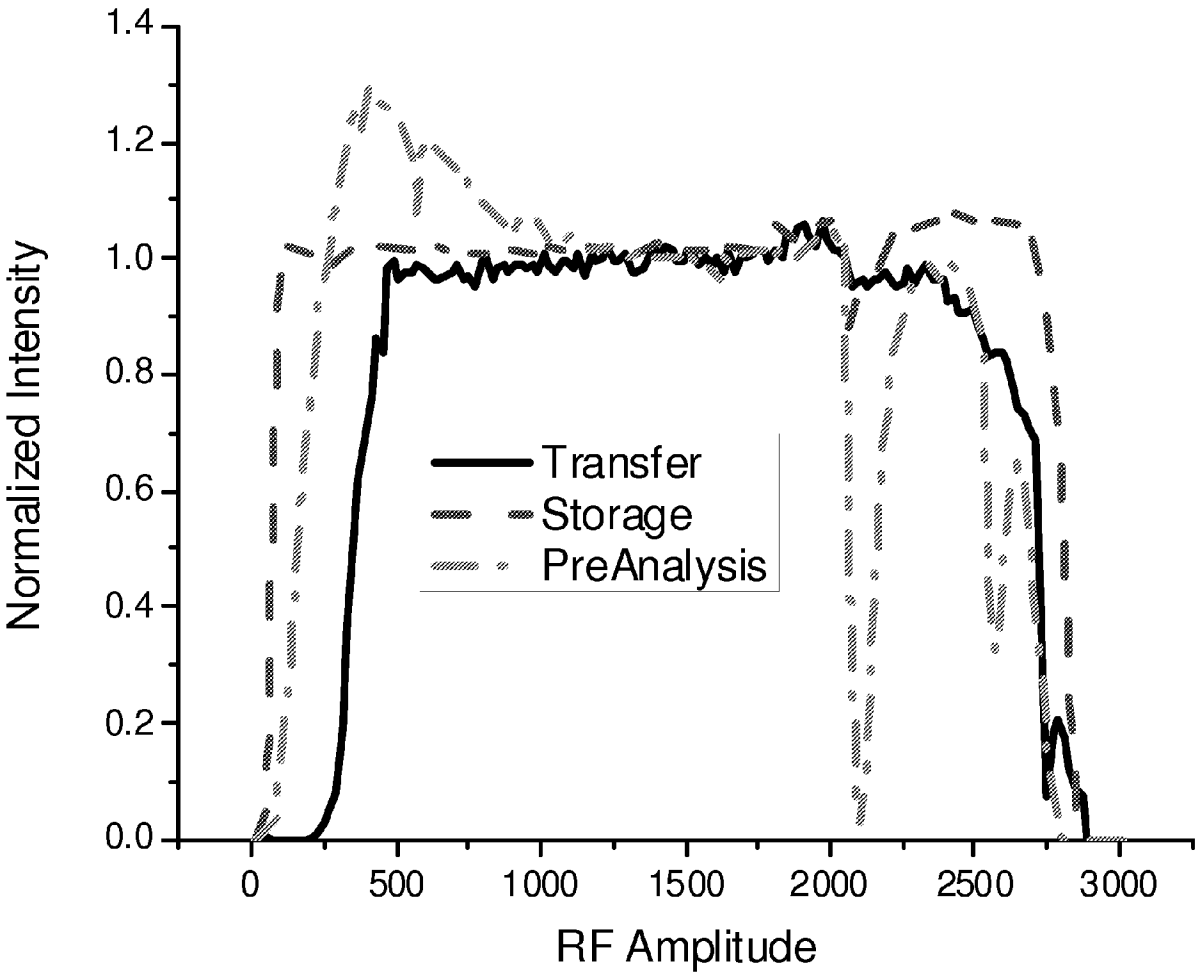
FIG. 5 is an exemplary graph showing the ion intensity as a function RF amplitude under various conditions.

A larger range can be more desirable than a smaller one. Transferring ions into an ion trap and preparing the ions for transfer out of the ion trap can restrict the mass range. One way to diminish the magnitude of the problem is to use different RF amplitude set points for ion traps exhibiting field resonances during different portions of the scan procedures. Typically, an ion trap RF amplitude is set such that the lowest mass in the spectrum would have a frequency just less than that of the lowest frequency resonance. In various embodiments disclosed herein, the lowest mass in the spectrum is set to a higher frequency; up to the highest frequency at which it is still stable during times where the ions are less affected by the field resonances, such as during transfer into the ion trap and during storage, while just before analysis, the voltage can dropped below the lowest resonance to avoid the resonance effects when they field resonances most strongly affect the ions. In various embodiments, the disclosed procedure can increase the mass range, i.e.

$$MR = \frac{V_{xferMax}}{V_{analysisMin}}$$

as the maximum voltage is elevated during transfer of the ions into the ion trap and the minimum voltage is lower during analysis/pre-analysis. With reference to FIG. 5 described below, it can be noted that the minimum voltage needed to trap the m/z 195 ion during transfer is substantially higher than the minimum voltage needed during pre-analysis.

Figure 3:
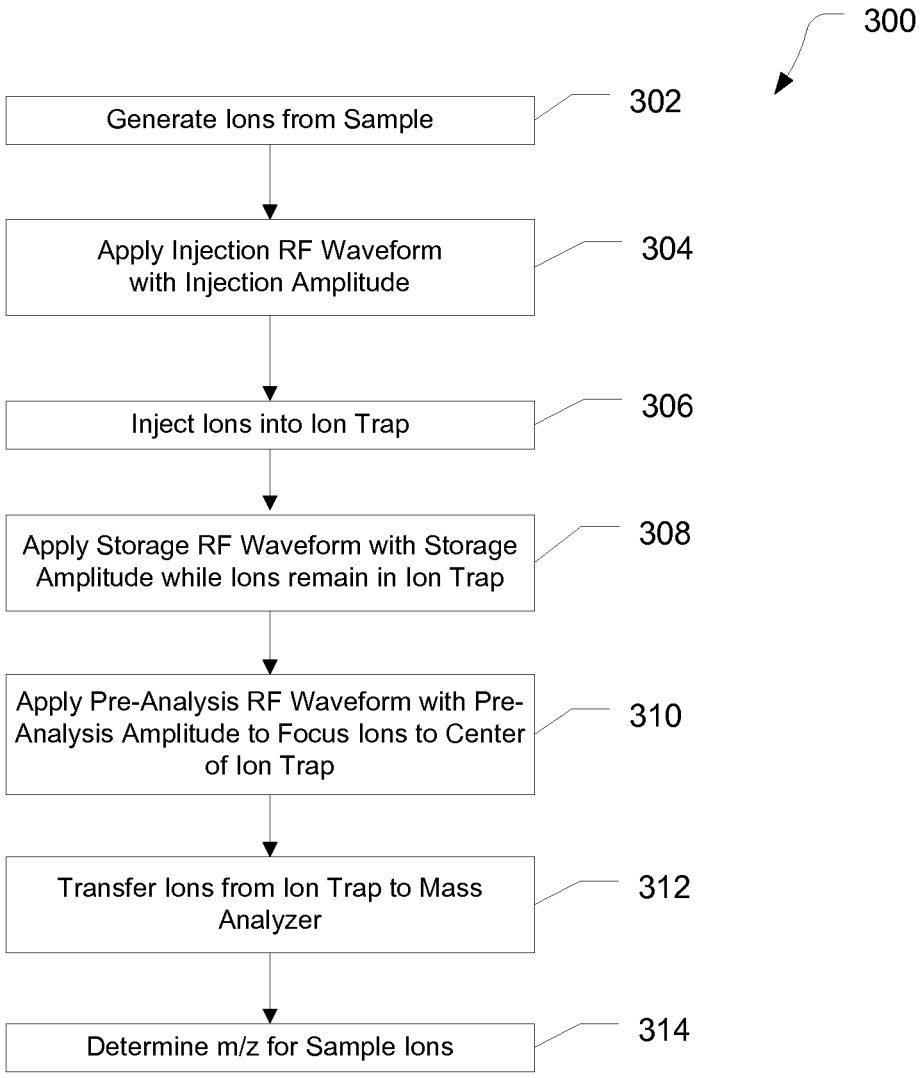
FIG. 3 is a flow diagram of an exemplary method for operating a multipole during analysis of a sample, in accordance with various embodiments.

FIG. 3 is a flow diagram of an exemplary method 300 for analyzing a sample. At 302 the system can generate ions from a sample. In various embodiments, the sample can be provided in liquid form which can be volatilized and ionized, in a gas form that can be ionized, or in a solid or semi-solid form that can be ablated to form ions. The ions can be generated by an ion source, such as ion source 102 in FIG. 1 or ion source 202 in FIG. 2.

At 304, the system can apply an injection waveform to the ion trap with field resonances. While the ion trap with field resonances can be a C-trap like C-trap 210 in FIG. 2, the ion trap may have other ion trap geometries, including linear ion trap geometries, that can result in field resonances due to perturbations in the electrode structure. The injection waveform can have an injection RF amplitude such that at least some ions within the ion trap can have a secular frequency above the field resonance.

At 306, ions can be injected into the ion trap. As the ions enter the ion trap, the injection waveform can act to trap ions within the range of mass-to-charge (m/z) ratios.

At 308, a storage RF waveform can be applied to the ion trap. The storage RF waveform can act to reduce radial motions of the ions (cool the ions) within the trap and to maintain the ions near the longitudinal axis of the ion trap. In various embodiments, similar to the injection waveform, the storage waveform can have an RF amplitude such that at least some ions within the ion trap have a secular frequency above the field resonance.

In various embodiments, the injection RF waveform and the storage RF waveform can constrain the ions radially to minimize the influence of the field resonances.

At 310, a pre-analysis RF waveform can be applied to the ion trap. The pre-analysis RF waveform can prepare the ions for ejection from the ion trap. In various embodiments, this can be a radial ejection from the ion trap. In particular embodiments, the ions can be focused towards the center of the ion trap and away from the ends of the ion trap. Due to the increased ion density from the focusing of the ions, the ions may spread radially and experience greater influence from the field resonances. The pre-analysis RF waveform can have an RF amplitude such that the ions within the ion trap have a secular frequency less than the field resonances of the ion trap. That is, the RF amplitude of the pre-analysis RF waveform can be selected to avoid resonances caused by the field non-linearities within the ion trap. The ions, having a secular frequency below the field resonances can remain in the trap rather than being ejected by the field resonances during the pre-analysis pulse. In various embodiments the RF amplitude of the pre-analysis RF waveform can be less than the RF amplitude of either the injection RF waveform or the storage RF waveform.

At 312, the ions can be transferred from the ion trap to the mass analyzer. Due to the focusing of the ions by the pre-analysis RF waveform, the ions can be tightly clustered in to a small volume when transferred into the mass analyzer. In particular embodiments where the ion trap is a C-trap, such as C-trap 210 in FIG. 2, the curvature of the C-trap can further focus the ions before entering the mass analyzer. At 314, the mass analyzer can determine the m/z ratio of the ions within the sample.

In various embodiments, using a RF amplitude above a threshold where ions in the ion trap have secular frequencies above the field resonance of the ion trap during the injection and storage stage, while lowing the RF amplitude during the pre-analysis state to be below the threshold so that ions in the ion trap have secular frequencies below the field resonance of the ion trap can increase the mass range of the ions that are transferred to the mass analyzer.

Computer-Implemented System

Figure 4:
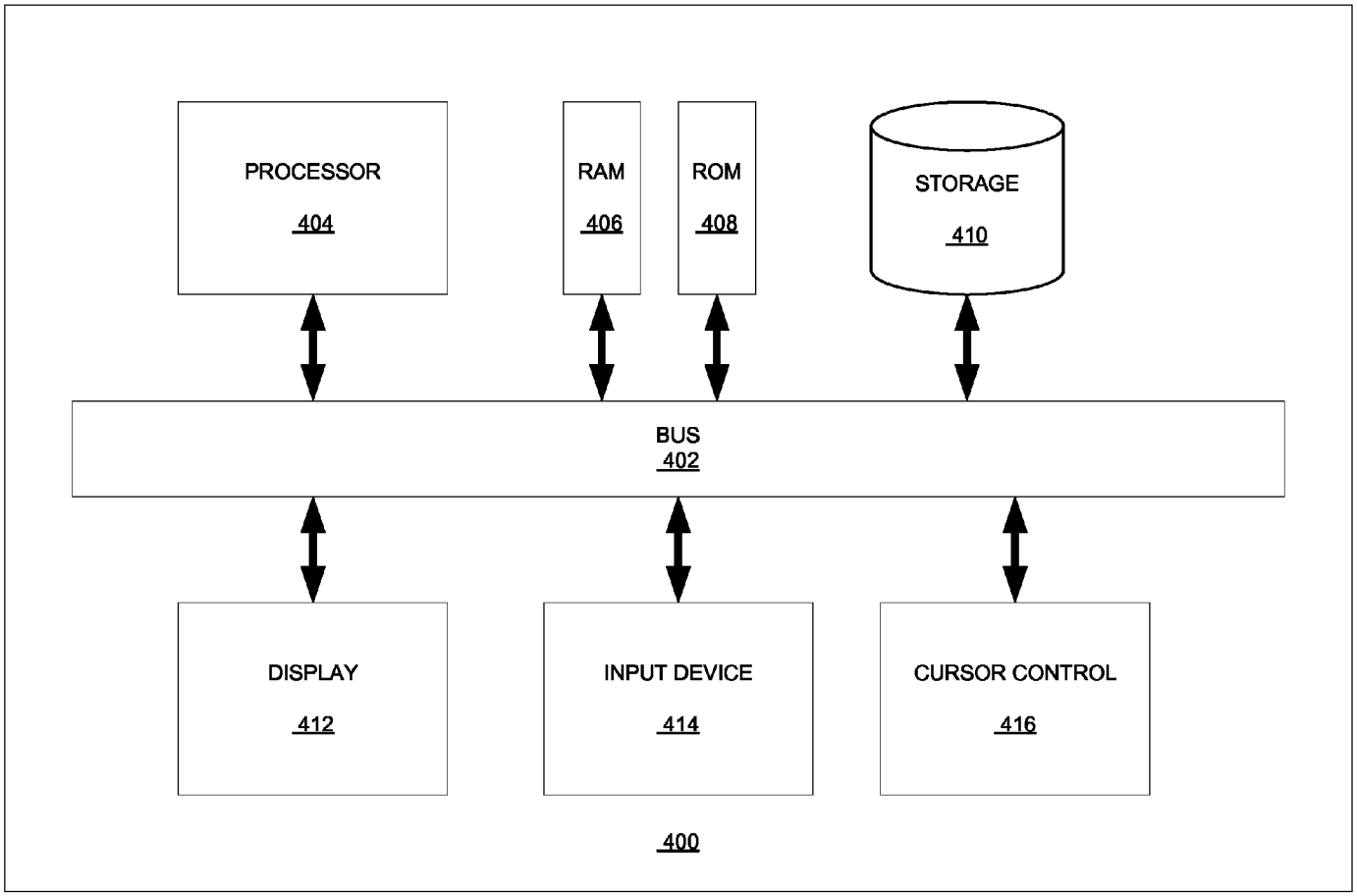
FIG. 4 is a flow block illustrating an exemplary computer system, in accordance with various embodiments.

FIG. 4 is a block diagram that illustrates a computer system 400, upon which embodiments of the present teachings may be implemented as which may incorporate or communicate with a system controller, for example controller 108 shown in FIG. 1, such that the operation of components of the associated mass spectrometer may be adjusted in accordance with calculations or determinations made by computer system 400. In various embodiments, computer system 400 can include a bus 402 or other communication mechanism for communicating information, and a processor 404 coupled with bus 402 for processing information. In various embodiments, computer system 400 can also include a memory 406, which can be a random access memory (RAM) or other dynamic storage device, coupled to bus 402 for determining base calls, and instructions to be executed by processor 404. Memory 406 also can be used for storing temporary variables or other intermediate information during execution of instructions to be executed by processor 404. In various embodiments, computer system 400 can further include a read only memory (ROM) 408 or other static storage device coupled to bus 402 for storing static information and instructions for processor 404. A storage device 410, such as a magnetic disk or optical disk, can be provided and coupled to bus 402 for storing information and instructions.

In various embodiments, computer system 400 can be coupled via bus 402 to a display 412, such as a cathode ray tube (CRT) or liquid crystal display (LCD), for displaying information to a computer user. An input device 414, including alphanumeric and other keys, can be coupled to bus 402 for communicating information and command selections to processor 404. Another type of user input device is a cursor control 416, such as a mouse, a trackball or cursor direction keys for communicating direction information and command selections to processor 404 and for controlling cursor movement on display 412. This input device typically has two degrees of freedom in two axes, a first axis (i.e., x) and a second axis (i.e., y), that allows the device to specify positions in a plane.

A computer system 400 can perform the present teachings. Consistent with certain implementations of the present teachings, results can be provided by computer system 400 in response to processor 404 executing one or more sequences of one or more instructions contained in memory 406. Such instructions can be read into memory 406 from another computer-readable medium, such as storage device 410. Execution of the sequences of instructions contained in memory 406 can cause processor 404 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 404 for execution. Such a medium can take many forms, including but not limited to, non-volatile media, volatile media, and transmission media. Examples of non-volatile media can include, but are not limited to, optical or magnetic disks, such as storage device 410. Examples of volatile media can include, but are not limited to, dynamic memory, such as memory 406. Examples of transmission media can include, but are not limited to, coaxial cables, copper wire, and fiber optics, including the wires that comprise bus 402.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, C#, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

Results

FIG. 5 illustrates the effect of the field resonances on ion intensities. The intensity of ions having a m/z of 195 is monitored at various RF amplitudes for the injection waveform, the storage waveform, and the pre-analysis waveform. The pre-analysis waveform shows significant drops in the ion intensity above 2000 V where the ion secular frequency coincides with field resonances. While there are slight decreases when the amplitude of the transfer and storage waveforms exceeds 2000 V, there is not a significant drop off until the amplitude of the transfer and storage waveforms exceed 2600 V. The transfer waveform shows a significantly higher low voltage onset of stability, due to the need to confine ions with significant axial energy. During storage, the onset of stability starts at much lower voltage.

Figure 6:
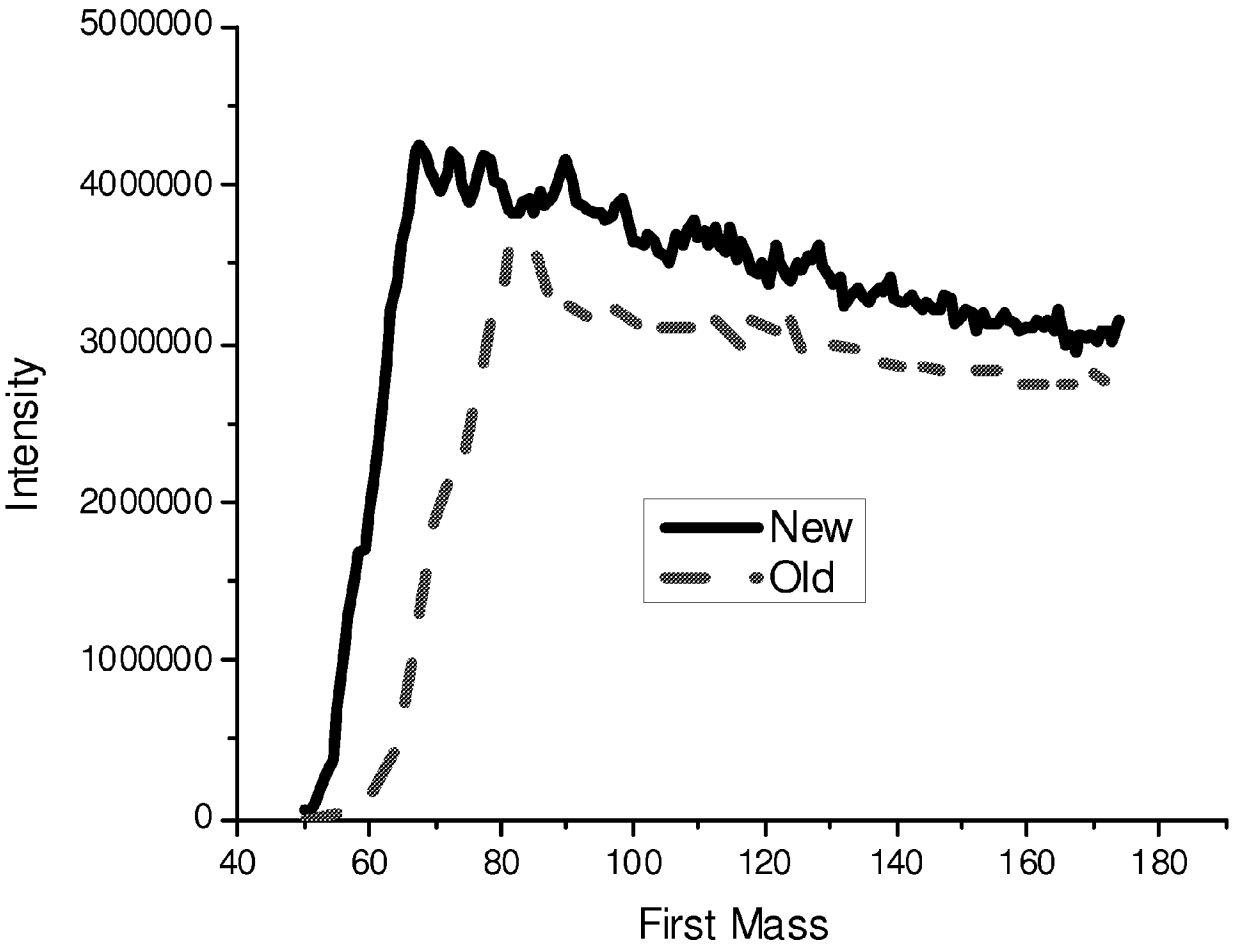
FIG. 6 is an exemplary graph showing the intensity of a particular ion as the first acquisition mass is varied.

FIG. 6 illustrates the improvements seen by increasing the amplitude of the transfer and storage waveforms while maintaining the pre-analysis waveform below the threshold needed to avoid the resonance effects. The intensity of ions having a m/z of 524 are monitored as the first acquisition mass is varied. The amplitude of the waveforms are varied proportionally to the first acquisition mass. Using previous methods where the RF amplitudes of the transfer, storage, and pre-analysis waveforms are all maintained below the threshold needed to avoid the resonance effects, significant intensity at 524 is not achieved until the first acquisition mass is set to about 80. Using the methods described herein, significant intensity at m/z 524 is achieved at about 60.

What is claimed is:

1. A method for identifying components of a sample comprising:

providing a sample to an ion source and generating a plurality of ions from constituent components of the sample;

applying a first RF waveform at a first RF amplitude to an ion trap with field resonances while directing the plurality of ions into the ion trap;

applying a second RF waveform at a second RF amplitude to the ion trap while focusing the plurality of ions towards a center of the ion trap along a longitudinal axis;

ejecting the plurality of ions from the ion trap into a mass analyzer;

using the mass analyzer to determine the mass-to-charge ratio of the ions, wherein the first and second RF amplitudes are selected to increase the mass range of ions that are ejected into the mass analyzer and the second amplitude is selected to avoid resonances caused by field non-linearities within the ion trap.

2. The method of claim 1 wherein the first amplitude is greater than the second amplitude.

3. The method of claim 1 further comprising applying a third RF waveform at a third amplitude after the ions have entered the ion trap and before the ions are focused towards the center of the ion trap.

4. The method of claim 3 wherein the third amplitude is greater than the second amplitude.

5. The method of claim 1 wherein at least a portion of the ions within the ion trap have a secular frequency at a first amplitude above at least one of the field resonances of the ion trap.

6. The method of claim 1 wherein the ions within the ion trap have a secular frequency at the second amplitude less than the field resonances of the ion trap.

7. A system for analyzing a sample comprising:

a source configured to generate ions from constituent components of the sample;

a mass analyzer configured to determine the mass-to-charge ratio of the ions;

a curved ion trap with field resonances configured to focus ions and transfer the ions to the mass analyzer; and a RF controller configured to:

apply a first RF waveform at a first RF amplitude to the ion trap while directing the plurality of ions into the ion trap; and apply a second RF waveform at a second RF amplitude to the ion trap while focusing the plurality of ions towards a center of a curvature of the curved ion trap.

8. The system of claim 7 wherein the second amplitude is selected to avoid resonances caused by field non-linearities within the ion trap.

9. The system of claim 7 wherein the first amplitude is greater than the second amplitude.

10. The system of claim 7 wherein the RF controller is further configured to apply a third RF waveform at a third amplitude after the ions have entered the curved ion trap and before the ions are focused towards the center of the ion trap.

11. The system of claim 10 wherein the third amplitude is greater than the second amplitude.

12. The system of claim 7 wherein at least a portion of the ions within the ion trap have a secular frequency at the first amplitude above at least one of the field resonances of the curved ion trap.

13. The system of claim 7 wherein the ions within the ion trap have a secular frequency at a second amplitude less than the field resonances of the curved ion trap.

14. A method for identifying components of a sample comprising:

providing a sample to an ion source and generating a plurality of ions from constituent components of the sample;

applying a first RF waveform at a first RF amplitude to a curved ion trap with field resonances while directing the plurality of ions into the ion trap;

applying a second RF waveform at a second RF amplitude to the curved ion trap while focusing the plurality of ions towards a center of a curvature of the curved ion trap;

ejecting the plurality of ions from the ion trap into a mass analyzer;

using the mass analyzer to determine the mass-to-charge ratio of the ions, wherein the second RF amplitude is below a threshold selected to avoid resonances caused by field non-linearities within the ion trap and the first RF amplitude is above the threshold.

15. The method of claim 14 wherein the first and second RF amplitudes are selected to increase the mass range of ions that are ejected into the mass analyzer.

16. The method of claim 14 further comprising applying a third RF waveform at a third amplitude after the ions have entered the curved ion trap and before the ions are focused towards the center of the ion trap.

17. The method of claim 16 wherein the third amplitude is greater than the second amplitude.

18. The method of claim 14 wherein at least a portion of the ions within the ion trap have a secular frequency at the first amplitude above the field resonances of the curved ion trap.

19. The method of claim 14 wherein the ions within the ion trap have a secular frequency at the second amplitude less than the field resonances of the curved ion trap.

* * * * *